US012624407B2

(12) United States Patent
Hensen et al.

(10) Patent No.: US 12,624,407 B2
(45) Date of Patent: May 12, 2026

(54) METHOD OF MANUFACTURING A STEEL STRIP AND COATED STEEL SHEET OBTAINABLE THEREBY

(71) Applicant: TATA STEEL IJMUIDEN B.V., Velsen-Noord (NL)

(72) Inventors: Guido Cornelis Hensen, Haarlem (NL); Roel Marinus Maria Mallens, Beverwijk (NL); Freek Sluis, Haarlem (NL); Jean-Paul Gravemaker, Umuiden (NL); Edgar Matthijs Toose, Hoofddorp (NL)

(73) Assignee: TATA STEEL IJMUIDEN B.V., Velsen-Noord (NL)

( * ) Notice: Subject to any disclaimer, the term of this patent is extended or adjusted under 35 U.S.C. 154(b) by 747 days.

(21) Appl. No.: 18/002,635

(22) PCT Filed: Jun. 29, 2021

(86) PCT No.: PCT/EP2021/067911
§ 371 (c)(1),
(2) Date: Dec. 20, 2022

(87) PCT Pub. No.: WO2022/002973
PCT Pub. Date: Jan. 6, 2022

(65) Prior Publication Data

US 2023/0323495 A1 Oct. 12, 2023

(30) Foreign Application Priority Data

Jun. 30, 2020 (EP) ..... 20183326

(51) Int. Cl.
*C21D 9/46* (2006.01)
*C21D 8/02* (2026.01)
(Continued)

(52) U.S. Cl.
CPC ..... *C21D 8/0226* (2013.01); *C21D 8/0236* (2013.01); *C21D 9/46* (2013.01);
(Continued)

(58) Field of Classification Search
None
See application file for complete search history.

(56) References Cited

U.S. PATENT DOCUMENTS

2018/0257121 A1 9/2018 Jeon
2019/0022721 A1 1/2019 Shafiei et al.

FOREIGN PATENT DOCUMENTS

JP 2006265614 A 10/2006

OTHER PUBLICATIONS

International Search Report mailed Aug. 26, 2021 for PCT/SEP2021/067911 filed Jun. 29, 2021.
(Continued)

*Primary Examiner* — Jenny R Wu
(74) *Attorney, Agent, or Firm* — Vorys, Sater, Seymour and Pease LLP; Maryellen Feerhery Hank; Anthony P. Venturino

(57) ABSTRACT

A method manufacturing a steel strip, including the subsequent steps of hot rolling the strip into a hot rolled strip, cold rolling the hot rolled strip and hot dip coating the cold rolled strip with a Zn based coating by leading the strip through a bath including molten zinc and wiping the strip after the coating using a gas knife having a knife slot from which a wiping gas is projected and the steel strip is cold rolled to a final cold rolled thickness of between 0.40 mm and 1.00 mm in a multi-stand cold rolling mill, and the coated steel sheet includes a steel substrate provided with a hot dip metal coating.

20 Claims, 2 Drawing Sheets

Figure 1:
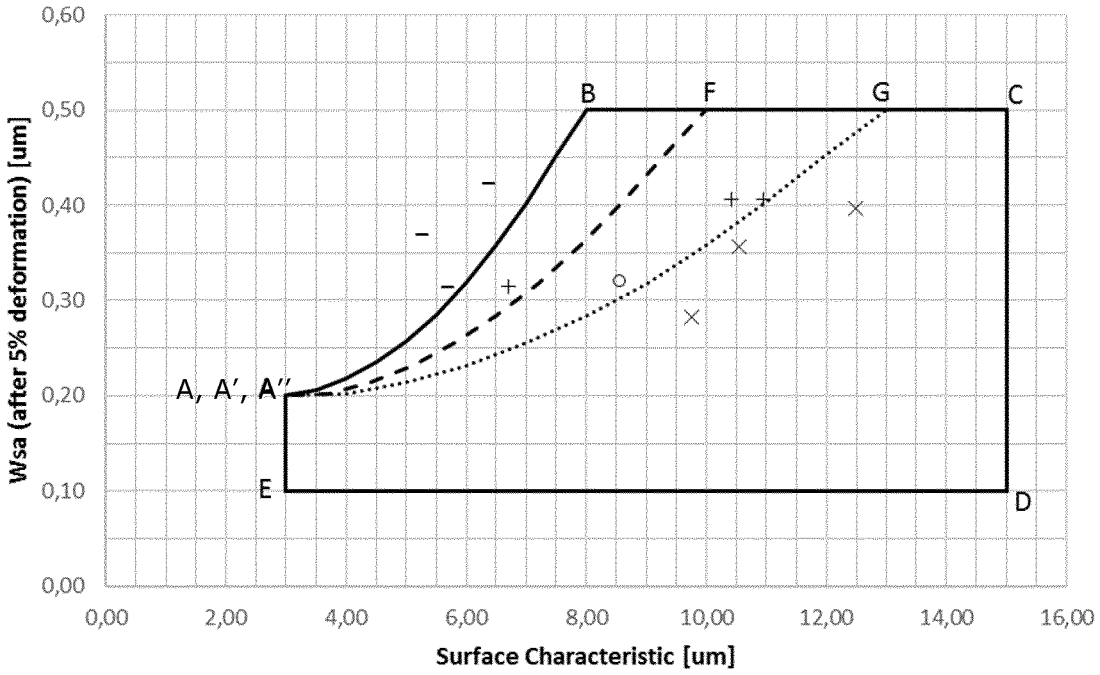

(51) Int. Cl.

| | |
|---|---|
| ***C21D 8/0221*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/60*** | (2006.01) |
| ***C23C 2/00*** | (2006.01) |
| ***C23C 2/02*** | (2006.01) |
| ***C23C 2/06*** | (2006.01) |
| ***C23C 2/20*** | (2006.01) |
| ***C23C 2/28*** | (2006.01) |

(52) U.S. Cl.

CPC ..... *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/60* (2013.01); *C23C 2/0035* (2022.08); *C23C 2/02* (2013.01); *C23C 2/022* (2022.08); *C23C 2/024* (2022.08); *C23C 2/06* (2013.01); *C23C 2/20* (2013.01); *C23C 2/28* (2013.01); *C23C 2/29* (2022.08)

(56) References Cited

OTHER PUBLICATIONS

Deutscher, O., et al., "Characterising the surface waviness of hot dip galvanised steel sheets for optical high-quality paintability (Carsteel)", Luxembourg: Office for Official Publications of the European Communities, Research Fund for Coal and Steel series, (2009), XP002717503, DOI: 10.2777/65928, 140 pages.

International Preliminary Report on Patentability, mailed Sep. 2, 2022 for PCT/SEP2021/067911 filed Jun. 29, 2021.

METHOD OF MANUFACTURING A STEEL STRIP AND COATED STEEL SHEET OBTAINABLE THEREBY

This invention relates to a method of manufacturing a steel strip, comprising the subsequent steps of hot rolling the strip into a hot rolled strip, cold rolling the hot rolled strip and hot dip coating the cold rolled strip with a Zn based coating by leading the strip through a bath comprising molten zinc and wiping the strip after said coating using a gas knife having a knife slot from which a wiping gas is projected, as well as to a coated steel sheet comprising a steel substrate provided with a hot dip metal coating obtainable by the method.

Methods of this kind and the resulting products are widely known throughout the steel industry. A steel strip suitable for hot dip coating is produced by hot rolling a steel slab into a hot rolled strip, which is subsequently pickled and cold rolled into a cold rolled strip, in a multi-stand cold rolling mill. The cold rolled strip is subsequently coated in a continuous hot dip coating line.

Continuous hot dip coating lines are widely used and employed everywhere in the world. Hot dip coating was originally developed for galvanising i.e. zinc-coating, but is now also used to apply other metals or metal alloys to the steel sheet.

In continuous hot dip coating the cold rolled steel strip is passed as a continuous ribbon through a bath of molten metal at high speeds. In the molten metal bath the steel strip reacts with the molten metal and the coating bonds onto the strip surface. The strip passes one or more submerged rolls and exits the bath in a vertical direction. Above the exit point a set of gas knives wipes off excess molten metal allowing a controlled thickness of coating usually expressed as weight of coating per unit area on the strip surface. After cooling the strip feeds into the exit end of the hot dip coating line often comprising a temper mill, also called skin pass mill. As wiping gas normally air or nitrogen gas is used. For producing high quality coated products normally nitrogen gas is used.

Originally hot dip coated steel sheets were used for applications that did not demand a high quality finish or a high degree of formability, but in recent times they are increasingly used for more demanding applications such as for automotive hoods, fenders and doors.

The surface quality of the coated steel sheets is influenced by defects of several types. The main types of defects are dross type defects, furnace defects and coating defects, the latter being related to solidification and oxidation of the liquid metal during the hot dip coating process.

For the improvement of the surface quality it is important not only to find a way to reduce dross type and furnace defects, but also to find a way to reduce these coating defects. If such an improvement is found, this immediately leads to further improvement of the product since the other types of defects become more prominent and can be eliminated in a targeted way. Further, it also enables the declassification of problematic sheets because other defects are no longer missed, so that on balance a product with better surface quality is sold to the market.

Several ways to improve the surface quality of the subject products have been proposed, especially also as regards reduction of coating defects as mentioned above. One proposed solution is to reduce the level of oxygen in the atmosphere surrounding the steel strip after hot dipping. Another proposed solution is to vary amounts of certain elements such as Al and or Mg in the hot dip bath, or to add very specific elements such as Be or Ga to it.

Both solutions to improve the surface quality of the coated sheets have their downsides. The first one requires the use of a confinement box shielding the coated strip. Such a box limits the visibility of the strip and limits the room for positioning the wiping device and any further devices including skimming equipment, all required for optimal control of the hot dip coating process. The second one is often unsatisfactory as the in-use application properties such as sensitivity to filiform corrosion or corrosion resistance are compromised.

It is an objective of the invention to provide an improved method for manufacturing a hot dip coated steel sheet with a high surface quality, in which the number of defects is low, and which has a low waviness in the final product, e.g. a visible part of an automobile body.

It is also an objective to provide an improved hot dip coated steel sheet, that is suitable especially for use in a visible part of an automobile body.

These objectives are achieved according to the independent claims. Preferred embodiments are defined in the respective dependent claims. It should be noted that the features listed in the claims can be combined in any technically meaningful manner to describe further embodiments of the invention. The following specification explains the features of the inventions and contains additional embodiments of the invention. Further, it should be noted that features described in connection with the proposed method of manufacturing a steel strip can be used to further explain the features of the proposed coated steel sheet and vice versa.

According to the invention, in the method:

the steel strip is cold rolled to a final cold rolled thickness of between 0.40 mm and 1.00 mm in a multi-stand cold rolling mill wherein cold rolling in the last stand takes place such that:

$$\frac{SRF}{AWR} \geq 21000 \text{ kN/m}^2$$

wherein SRF is the specific rolling force expressed in kN/m calculated as the rolling force in kN divided by the strip width in m, and AWR is the average work roll radius in m of the top and bottom work roll at mid roll position.

It will be clear that the top and bottom work roll designate the two rolls in a mill stand that are in contact with the strip that is being rolled.

Surprisingly, it was found in manufacturing this kind of hot dip coated steel strip, that not only the conditions of the hot dip coating process step may play a role in realising the best surface quality of the product, but that also the value of the mentioned parameter in the cold rolling process step plays a paramount role. This parameter according to the invention in fact sets a whole new standard for manufacturing outstanding surface quality on hot dip coated steel products.

As it turned out, working according to the invention not only reduced what were believed to be "coating" defects such as the localized tiny wrinkles described above, but it also led to a reduction in the presence of dross defects and many other defects when comparing different cold rolling regimes under equal hot dip coating circumstances. It was found that the defects observed by the camera inspection systems reduced significantly when the invention was applied, potentially leading to increased production volumes and higher yield in the production of top quality hot dip coated steel sheets.

In further embodiments of the method according to the invention cold rolling in the last stand takes place such that in the order of preference:

$$\frac{SRF}{AWR} \geq 22000 \text{ kN/m}^2,$$

$$\frac{SRF}{AWR} \geq 23000 \text{ kN/m}^2,$$

$$\frac{SRF}{AWR} \geq 24000 \text{ kN/m}^2,$$

$$\frac{SRF}{AWR} \geq 25000 \text{ kN/m}^2,$$

$$\frac{SRF}{AWR} \geq 26000 \text{ kN/m}^2, \text{ or even}$$

$$\frac{SRF}{AWR} \geq 27000 \text{ kN/m}^2.$$

The higher the value of the specific rolling force divided by the average work roll radius of the top and bottom work roll at a position in the middle of the work roll is chosen, the more prominent the beneficial effect on the surface quality of the product after hot dip coating is.

It is beneficial if cold rolling in the last stand takes place using work rolls that have a roughness Ra, which is 7 μm or less, preferably 6 μm or less, more preferably 5 μm or less but in all cases 1.0 μm or more. As it turns out in these roughness ranges good results are achieved which are even better if the preferred ranges are used.

In cases where strip tracking is important, in particular to keep the strip well centred in the hot dip coating line, it is preferred that this roughness is 3.0 μm or more.

The surface roughness of the work rolls in the last stand may be created by grinding and subsequent electrical discharge roll texturing ("EDT"). EDT allows accurate control of roughness parameters like Ra and Rpc of the work rolls.

In an embodiment the method is characterised by observing GKD≤10 mm wherein GKD is the average distance between the knife slot from which the wiping gas is projected and the surface of the coated strip that is being wiped. Whilst it is known that GKD plays a role in hot dip coating in relation to the production of a certain coating weight at a certain coating line speed using a certain pressure with wiping knives that have certain dimensions, it has turned out that a good surface quality product can be produced with GKD values of 10 mm or below.

In preferred embodiments GKD≤9 mm, GKD≤8 mm and GKD≤7 mm. If possible, the lower values are preferred because they turn out to lead to higher quality products; in particular this enables the realisation of a lower waviness in combination with the occurrence of less coating defects.

The strip may be stabilized by a magnetic device installed near the ideal strip path between the bath and the first guide roll to contact the strip downstream of the bath. The installing of such a device e.g. in the form of an electromagnetic strip stabilizer not only provides better control of the thickness of the hot dip coating layer, but also enables to work with the preferred lower GKD values without running the risk of the strip touching the wiping device and to produce a more uniform coating weight distribution over the width of the strip.

In an embodiment wherein the bath of molten metal has a composition comprising Zn, Al and Mg, wherein the strip after coating and wiping is cooled in a cooling section between the location where the strip is wiped and a downstream location where the strip is first contacted by a guiding roll, wherein an active cooling gas flow Q in m3/hr is used which is required to maintain the strip temperature within a bandwidth of 20 degrees of a target strip temperature in the range between 200° C. and 300° C. at said guiding roll, wherein the cooling gas flow in the second half of the cooling section is a percentage p of Q and the cooling gas flow in the first half of the cooling section is a percentage of (100-p) of Q, wherein p is set at 70% or more.

It was found that at a higher p it is possible to achieve a lower waviness of the coated product. Early cooling after wiping should be prevented as much as possible and that the cooling should take place as late as possible while still reaching the maximum desired temperature of the strip before it touches the said guiding roll, often referred to as top roll. It is therefore preferred that p=80% or more or even 90% or more.

In an embodiment the bath consists of 0.6-4.0 weight % aluminium and 0.3-4.0 weight % magnesium, up to 0.2 weight % each of an element belonging to the group of elements given by Pb, Sb, Ti, Ca, Mn, Sn, La, Ce, Cr, Ni, Zr and Bi, the remainder being unavoidable impurities and zinc.

It was found that the invention works particularly well with such coatings. The amount of an element belonging to the group of elements given by Pb, Sb, Ti, Ca, Mn, Sn, La, Ce, Cr, Ni, Zr and Bi may be up to 0.1 weight % for each element or may be up to 0.05 weight % for each element.

In further embodiments the aluminium content is 0.6-3.0 weight %, preferably 1.0-3.0 weight %, more preferably 1.5-2.0 weight % and/or the magnesium content is 0.3-2.0 weight %, preferably 1.0-2.0 weight %, more preferably 1.0-1.5 weight %. A relatively higher Mg content leads to better corrosion protection. The lower Al and Mg contents lead to better weldability and reduction of a surface feature known as "marble effect", a feature that may appear due to the solidification and oxidation behaviour of Zn—Al—Mg coatings.

In an alternative embodiment the bath consists of 0.25-0.90 weight % aluminium, preferably 0.25-0.50 weight % aluminium, and up to 0.2 weight % each of an element belonging to the group of elements given by Pb, Sb, Ti, Ca, Mn, Sn, La, Ce, Cr, Ni, Zr and Bi, the remainder being unavoidable impurities and zinc. The amount of an element belonging to the group of elements given by Pb, Sb, Ti, Ca, Mn, Sn, La, Ce, Cr, Ni, Zr and Bi may be up to 0.1 weight % for each element or may be up to 0.05 weight % for each 10 element.

As this coating in itself already leads to improvements in the surface quality of the coated steel sheet, it is beneficial to produce it according to the method of the invention and obtain a product with superior properties.

In an embodiment wherein the hot dip coated strip is temper rolled with an elongation of 0.5% or more, a temper work roll is used with an average diameter of 400 mm or more, more preferably of 500 mm or more, even more preferably of 600 mm or more. The average diameter is defined here as the average diameter of the top and bottom work roll at mid roll position.

These combinations of elongation and temper work roll diameters are beneficial for surface quality and roughness transfer.

In a preferred embodiment in the temper mill a temper work roll roughness Ra is used of 4.5 μm or less, preferably of 3.0 μm or less, more preferably of 2.5 μm or less. This achieves a lower waviness in the temper rolled coated steel sheet and higher peak counts that are beneficial for the appearance of a painted part made of the coated steel sheet.

The invention is also embodied in a coated steel sheet obtainable by the method, the sheet comprising a steel substrate provided with a hot dip metal coating, the steel substrate having a thickness of between 0.40 mm and 1.00 mm, wherein:

i) the steel substrate has a composition, all in weight:
C max 0.04;
Mn 0.01-1.20;
Si 0.001-0.50;
Al 0.005-0.1;
P max 0.15;
S max 0.045;
N max 0.01;
Mo max 0.12;
Ti max 0.12;
Nb max 0.12;
Cu: max 0.10;
Cr: max 0.06;
Ni: max 0.08;
B: max 0.0025;
V: max 0.01;
Ca: max 0.01;
Co: max 0.01;
Sn: max 0.01;
the remainder being iron and unavoidable impurities;

ii)) the coated steel sheet has a surface characteristic Sc, Sc being defined as: Sc=Sk/(0.7*t+0.3), wherein Sk in μm is defined according to NEN-EN-ISO 25178-2: 2012 and t is the thickness of the steel substrate in mm and iii) the coated steel sheet, after a 5% Marciniak bi-axial deformation, has a waviness Wsa which is the Wsa (1-5) value in μm, measured in rolling direction, according to SEP 1941, iv) wherein the combination Sc and Wsa lies within an area defined by a contour ABCDEA in an XY plot of Sc and Wsa respectively, wherein:
A is defined as the intersection of Sc=3.00 and Wsa=(0.2686)−(0.0543*Sc)+(0.0105*Sc∧2);
AB is defined by Wsa=(0.2686)−(0.0543*Sc)+(0.0105*Sc∧2) from Sc=3.00 at
A to Wsa=0.50 at B;
BC is defined by Wsa=0.50 from B to C, C having Sc=14.50;
CD is defined by Sc=14.50 for Wsa=0.50 at C to Wsa=0.10 at D;
DE is defined by Wsa=0.10 for Sc=14.50 at D to Sc=3.00 at E; and
EA closes the contour and is defined by Sc=3.00 from E to A.

As it turns out, a hot dip coated steel product will have a very good surface quality in the end application, e.g. as the visible side of a body part of a car, if a steel sheet comprising the steel substrate provided with a hot dip metal coating according to the invention has the above features. Sk as used in this patent document, is a surface characterisation parameter also named "core roughness", which is measured according to NEN-EN-ISO 25178-2:2012.

In the experiments, Sk was measured with a confocal microscope using WinSam 2.6 software to filter the measurement data and to calculate Sk. Details regarding the Sk measurements were: Equipment from supplier Nanofocus; Equipment type μSurf Mobile (also named Marsurf mobile); Objective MPlanApo N 800XS (20x/0.60); Lateral spacing [μm] 1.56; Number of stitched fields 3*3; Measurement area 2.1*2.1 mm; Software WinSam 2.6; Calculation/evaluation area 2.0*2.0 [mm]; Filter Polynomial second degree; Penetration (kfl max)+10 [μm]; Penetration (kfl min)−10 [μm]; Number of steps 2000; Step width 10 [nm].

Sk may be measured with similar equipment and similar software as is commercially available.

In a preferred embodiment the combination Sc and Wsa lies within:
an area defined by a contour A'FCDEA' in an XY plot of Sc and Wsa respectively, wherein:
A' is defined as the intersection of Sc=3.00 and Wsa=(0.2276)−(0.0266*Sc)+(0.0054*Sc∧2);
A'F is defined by Wsa=(0.2276)−(0.0266*Sc)+(0.0054*Sc∧2) for Sc=3.00 at
A to Wsa=0.50 at F;
FC is defined by Wsa=0.50 from F to C, C having Sc=14.50;
CD is defined by Sc=14.50 for Wsa=0.50 at C to Wsa=0.10 at D;
DE is defined by Wsa=0.10 for Sc=14.50 at D to Sc=3.00 at E; and
EA' closes the contour and is defined by Sc=3.00 from E to A'.

This results in a hot dip coated steel product that will have an even better surface quality, especially in the end application.

In a more preferred embodiment the combination Sc and Wsa lies within:
an area defined by a contour A"GCDEA" in an XY plot of Sc and Wsa respectively, wherein:
A" is defined as the intersection of Sc=3.00 and Wsa=(0.208)−(0.0118*Sc)+(0.0027*Sc∧2);
A"G is defined by Wsa=(0.208)−(0.0118*Sc)+(0.0027*Sc∧2) for Sc=3.00 at A" to Wsa=0.50 at G;
GC is defined by Wsa=0.50 from G to C, C having Sc=14.50;
CD is defined by Sc=14.50 for Wsa=0.50 at C to Wsa=0.10 at D;
DE is defined by Wsa=0.10 for Sc=14.50 at D to Sc=3.00 at E; and
EA" closes the contour and is defined by Sc=3.00 from E to A".

This results in a hot dip coated steel product that will have optimum surface quality in the end application.

In a preferred embodiment the sheet has a total coating weight on both sides together of 60-175 g/m2, the coating weight being measured according to EN 10346:2015. The lower the coating weight, the lower the waviness that can be achieved with the hot dip coating.

In an embodiment the sheet has a surface roughness Ra between 0.9 μm and 1.8 μm, preferably between 0.9 μm and 1.6 μm and more preferably between 0.9 μm and 1.4 μm, the surface roughness being measured according to ISO-NEN 468-1982 with a 2.5 mm cut-off. These roughness values enable good waviness after deformation.

The invention is also embodied in the method discussed above, characterised in that it is performed with the purpose of producing a hot dip coated steel sheet having in its end use, in the final deformed state, a guaranteed maximum waviness Wsa which is the Wsa (1-5) value, measured in rolling direction, according to SEP 1941, of 0.35 μm, 0.34 μm, 0.33 μm, 0.32 μm, 0.31 μm, 0.30 μm, 0.29 μm, 0.28 μm or lower. It is remarkable that it was found that especially the measures taken in an upstream part of the manufacturing method such as in cold rolling, lead to the fulfilment of this purpose which is so important in connection with the end use e.g. in the visible body of an automobile.

The invention will now be described in more detail using drawings and a description of experiments.

Figure 2:
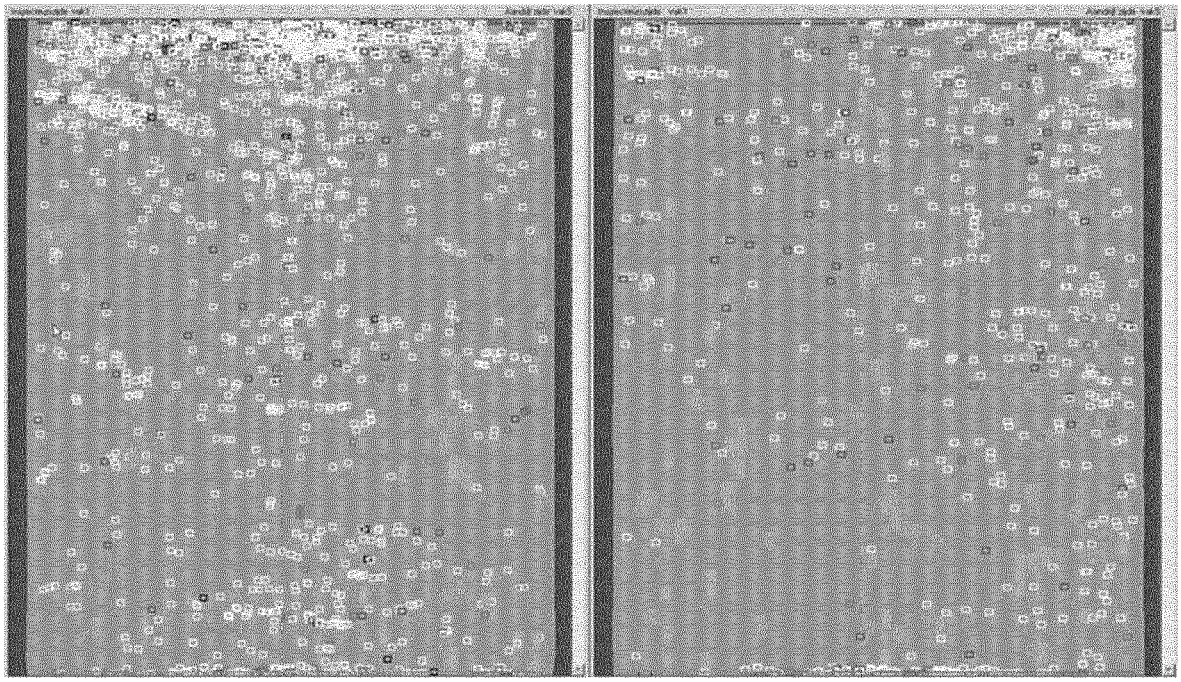
Figure 3:
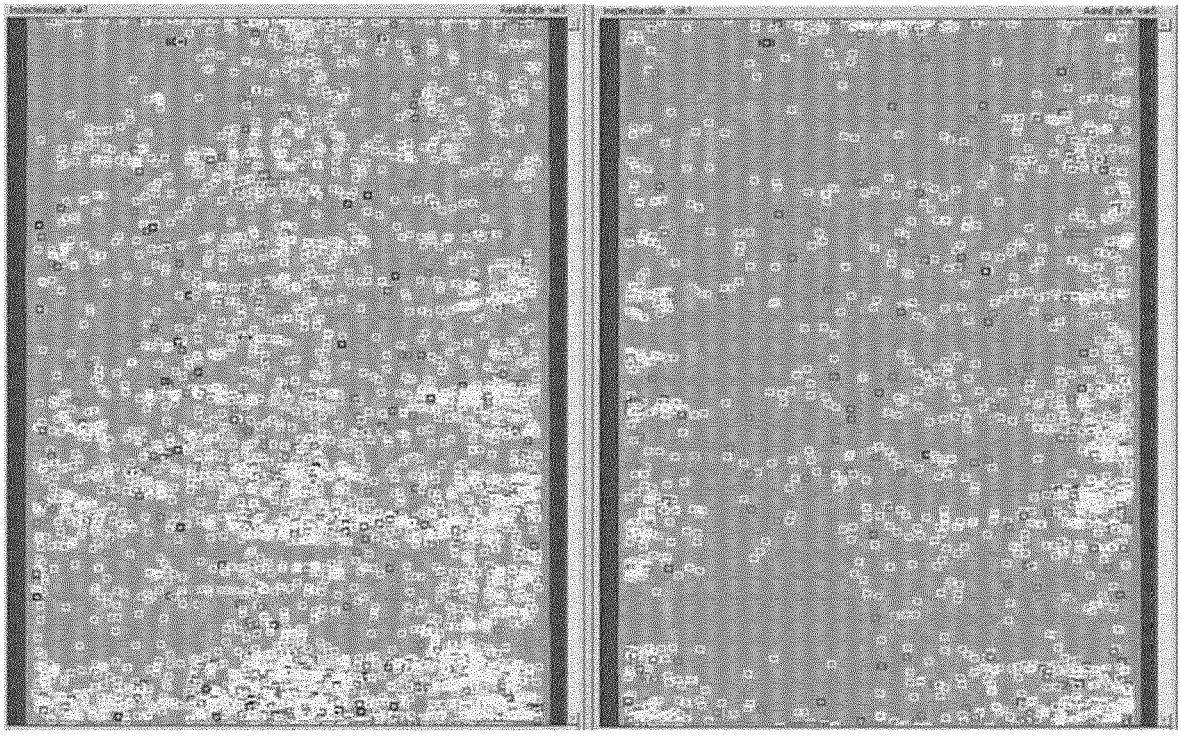

In the drawings:

FIG. 1 is an XY plot of Sc and (1-5) wherein the areas defined by the contours ABCDEA, A'FCDEA' and A"GCDEA" are shown, as well as combinations of Sc and Wsa resulting from experiments falling inside and outside the invention; and FIG. 2 shows a defect coil map of a coil of 4084 m length, 1460 mm width and 0.6 mm thickness. For this coil, 93.4% was classified as acceptable for surface critical applications. The remainder of the coil had too high local density of surface defects. This corresponds to surface quality ranking "++" according to table 2. The coil was processed at the cold mill with SRF=6130 kN/m and AWR=474 mm; and FIG. 3 shows a defect coil map of a coil produced directly after the one shown in FIG. 2, with the same process settings (line speed, GKD) in the galvanizing line. This coil was 4004 m in length, 1460 mm wide and 0.6 mm thick. For this coil, 75.5% was classified as acceptable for surface critical applications. This corresponds to surface quality ranking "+" according to table 2. The coil was processed with SRF=5052 kN/m and AWR=430 mm.

In order to perform experiments samples were made by casting steel slabs followed by hot rolling the slabs in a hot rolling mill to provide a hot rolled steel strip, processing the hot rolled steel strip in a pickling line, cold rolling the pickled steel strip in a cold rolling mill, annealing and hot dip coating the cold rolled strip, temper rolling in a temper rolling mill, also referred to as skin passing in a skin pass rolling mill.

Unless otherwise specified in the tables or text, the settings of the manufacturing process up to and including hot rolling were according to normal practice.

In the course of the experiments, steel substrates manufactured from different steel casts were used, the steel substrates having compositions as given in the following table 1.

TABLE 1

Chemical composition of steel samples

| Example | C | Mn | P | Si | Mo | Ti | Nb | Al | N | B |
|---|---|---|---|---|---|---|---|---|---|---|
| | | | | mwt %* | | | | | | ppm* |
| 2.1 | 3 | 129 | 9 | 4 | 4 | 9 | 8 | 48 | 24 | 12 |
| 2.2 | 4 | 132 | 11 | 3 | 2 | 9 | 8 | 50 | 26 | 12 |
| 2.3 | 3 | 131 | 15 | 3 | 4 | 9 | 8 | 51 | 28 | 13 |
| 2.4 | 4 | 136 | 13 | 4 | 1 | 8 | 7 | 46 | 17 | 13 |
| 3.1 | 3 | 127 | 10 | 3 | 2 | 9 | 7 | 45 | 22 | 12 |
| 3.2 | 3 | 135 | 14 | 4 | 1 | 8 | 8 | 49 | 26 | 11 |
| 4.1 | 3 | 132 | 10 | 4 | 2 | 9 | 8 | 51 | 17 | 11 |
| 4.2 | 3 | 139 | 8 | 4 | 3 | 8 | 7 | 49 | 21 | 11 |
| 4.3 | 3 | 139 | 8 | 4 | 3 | 8 | 7 | 49 | 21 | 11 |
| 4.4 | 4 | 132 | 10 | 3 | 3 | 9 | 8 | 47 | 18 | 11 |
| 5.1 | 4 | 131 | 13 | 2 | 2 | 10 | 8 | 50 | 15 | 13 |
| 5.2 | 3 | 128 | 16 | 3 | 2 | 9 | 7 | 46 | 21 | 11 |
| 5.3 | 3 | 140 | 9 | 2 | 2 | 9 | 8 | 50 | 23 | 11 |
| 5.4 | 3 | 128 | 16 | 3 | 2 | 9 | 7 | 46 | 21 | 11 |
| 6.1 | 4 | 137 | 10 | 5 | 2 | 10 | 8 | 44 | 30 | 12 |
| 6.2 | 4 | 137 | 10 | 5 | 2 | 10 | 8 | 44 | 30 | 12 |
| 6.3 | 3 | 130 | 8 | 3 | 2 | 10 | 8 | 47 | 22 | 12 |
| 6.4 | 3 | 141 | 8 | 3 | 3 | 10 | 8 | 50 | 22 | 12 |
| 7.1 | 1 | 131 | 11 | 4 | 4 | 46 | 0 | 53 | 18 | 0 |
| 7.2 | 2 | 131 | 8 | 4 | 3 | 46 | 0 | 55 | 20 | 0 |
| 7.3 | 2 | 135 | 9 | 3 | 3 | 47 | 0 | 59 | 22 | 0 |

TABLE 1-continued

Chemical composition of steel samples

| Example | C | Mn | P | Si | Mo | Ti | Nb | Al | N | B |
|---|---|---|---|---|---|---|---|---|---|---|
| | | | | mwt %* | | | | | | ppm* |
| 7.4 | 3 | 136 | 9 | 5 | 5 | 47 | 0 | 55 | 26 | 1 |
| 8.1 | 2 | 94 | 7 | 4 | 4 | 69 | 0 | 56 | 29 | 0 |
| 8.2 | 1 | 98 | 7 | 4 | 5 | 66 | 0 | 51 | 30 | 0 |
| 9.1 | 1 | 107 | 7 | 4 | 6 | 62 | 0 | 46 | 24 | 0 |
| 9.2 | 1 | 107 | 7 | 4 | 6 | 62 | 0 | 46 | 24 | 0 |
| 9.3 | 1 | 114 | 10 | 4 | 4 | 64 | 0 | 55 | 25 | 1 |
| 9.4 | 1 | 112 | 8 | 4 | 6 | 66 | 0 | 61 | 23 | 1 |
| 9.5 | 1 | 112 | 8 | 4 | 6 | 66 | 0 | 61 | 23 | 1 |
| 9.6 | 1 | 112 | 8 | 4 | 6 | 66 | 0 | 61 | 23 | 1 |
| 10.1 | 3 | 450 | 42 | 5 | 3 | 10 | 8 | 48 | 21 | 11 |
| 10.2 | 3 | 450 | 42 | 5 | 3 | 10 | 8 | 48 | 21 | 11 |
| 10.3 | 3 | 450 | 42 | 5 | 3 | 10 | 8 | 48 | 21 | 11 |
| 10.4 | 3 | 450 | 42 | 5 | 3 | 10 | 8 | 48 | 21 | 11 |
| 10.5 | 3 | 457 | 41 | 3 | 5 | 9 | 8 | 48 | 18 | 10 |
| 11.1 | 4 | 141 | 16 | 5 | 2 | 10 | 7 | 47 | 29 | 13 |
| 11.2 | 4 | 141 | 13 | 5 | 2 | 10 | 7 | 44 | 17 | 12 |
| 11.3 | 3 | 128 | 14 | 4 | 3 | 10 | 7 | 45 | 24 | 12 |
| 11.4 | 3 | 129 | 9 | 5 | 2 | 10 | 8 | 50 | 22 | 12 |
| 12.1 | 4 | 134 | 10 | 4 | 2 | 8 | 8 | 48 | 17 | 11 |
| 12.2 | 3 | 132 | 10 | 4 | 3 | 10 | 8 | 48 | 20 | 11 |
| 12.3 | 3 | 139 | 11 | 4 | 4 | 9 | 8 | 47 | 23 | 12 |
| 12.4 | 4 | 131 | 13 | 2 | 2 | 10 | 8 | 50 | 15 | 13 |
| 12.5 | 2 | 131 | 8 | 4 | 3 | 46 | 0 | 55 | 20 | 0 |
| 12.6 | 3 | 133 | 7 | 5 | 5 | 46 | 0 | 58 | 33 | 1 |
| 12.7 | 3 | 128 | 9 | 3 | 4 | 9 | 7 | 45 | 22 | 11 |
| 12.8 | 2 | 131 | 8 | 4 | 3 | 46 | 0 | 55 | 20 | 0 |
| 12.9 | 1 | 107 | 7 | 4 | 6 | 62 | 0 | 46 | 24 | 0 |
| 12.10 | 2 | 130 | 7 | 4 | 5 | 67 | 0 | 53 | 24 | 0 |
| 13.1 | 3 | 136 | 11 | 5 | 5 | 45 | 0 | 56 | 34 | 0 |
| 13.2 | 2 | 133 | 9 | 3 | 4 | 47 | 0 | 51 | 23 | 1 |
| 13.3 | 2 | 133 | 9 | 3 | 4 | 47 | 0 | 51 | 23 | 1 |
| 13.4 | 2 | 136 | 6 | 3 | 4 | 43 | 0 | 50 | 38 | 1 |
| 13.5 | 2 | 133 | 9 | 3 | 4 | 47 | 0 | 51 | 23 | 1 |

*mwt % = weight %/1000,
ppm = weight %/10000

Hot rolled sample strip material was cold rolled in one and the same cold rolling campaign and hot dip coated according to the same hot dipping regime. The main data regarding the hot dip coating process were:

In the case of production of galvanised material ("GI") a Zn bath was used with a target aluminium amount of between 0.30% and 0.40%;

In the case of production of so called zinc magnesium coated material ("ZM") a Zn bath was used with a target amount of Mg of between 1.45% and 1.50% Mg, and a target amount of aluminium of between 1.70% and 1.75%; in practice the amount of Mg in the bath varied between 1.40% and 1.70% and the amount of Al varied between 1.60% and 1.80%.

Unless indicated otherwise, the knife slot width was 1.2 mm. The gas knife distance GKD was varied between 7 mm and 10 mm;

Production of the hot dip coated steel sheet examples was performed in batches. Within a batch, coils of similar steel composition, thickness and width were produced after each other. Quality of the strip was determined by visual inspection supported by camera inspection of the strip to assess the amount and severity of any defects on the strip. The ranking used for the description of the examples below is given in Table 2.

TABLE 2

| Surface quality ranking | Description |
|---|---|
| -- | No part of the coil suitable for surface critical applications |
| - | <25% of the coil can be used for surface critical applications |
| 0 | 25-75% of the coil can be used for surface critical applications |
| + | >75% of the coil can be used for surface critical applications |
| ++ | >90% of the coil can be used for surface critical applications |
| +++ | >95% of the coil can be used for surface critical applications |

The examples of two camera inspection defect maps (see FIG. 2 and FIG. 3) show the abrupt change in surface quality that can occur when coils with different rolling force in the final stand of the cold rolling mill are produced one after another. Each dot represents a surface feature classified as a defect by the camera inspection system across the width and length of the strip surface. The map shows both the bottom side (left) and the top side (right) of the strip. In this case the top side is the visible side in surface critical applications. The majority of the defects shown is classified as dross type defects.

During the investigation into the best conditions to achieve an excellent surface quality in terms of waviness and low defect count, it was observed that the number of defects detected by the camera inspection system could vary quite heavily between strip coils and that some combinations of steel composition, thickness and pre-processing tended to be worse than others. Strip coils with a high number of defects were rejected in the inspection step. An example is given below in Table 3, where it can be seen that examples 2.1 and 2.3 with ranking—were wholly rejected.

TABLE 3

| Example | Coating type | Thickness [mm] | Width [mm] | Target coating weight (sum of both sides) [g/m2] | Line speed [m/min] | Gas Knife Distance (GKD) [mm] | Temper mill reduction [%] | Defect count/m2 per side as classified by camera inspection system [indexed, example 2.1 = 100%] | Surface quality ranking |
|---|---|---|---|---|---|---|---|---|---|
| 2.1 | ZM | 0.60 | 1489 | 70 | 120 | 7 | 1.4 | 100 | -- |
| 2.2 | ZM | 0.65 | 1305 | 70 | 120 | 7 | 1.4 | 1 | + |
| 2.3 | ZM | 0.60 | 1489 | 70 | 120 | 7 | 1.4 | 65 | -- |
| 2.4 | ZM | 0.65 | 1305 | 70 | 120 | 7 | 1.2 | 10 | + |

The operators normally expect the cause of these quality deviations to lie in the hot dip coating process. They would vary the process settings in the hot dip coating line to improve the quality and bring it in accordance with the specifications. In such cases, line speed variations, bath level fluctuations and variations in furnace temperature or temper mill processing are suspected as potential causes for the deviations.

On the basis of the results of the experiments it was noticed that despite hot dip coating conditions being constant, the quality of the product varied, the variations seeming to correlate with the cold rolling regime. Coils that were processed according to one cold rolling regime demonstrated a higher number of surface defects than coils processed according to another cold rolling regime.

In order to analyse the role of the cold rolling regime on the surface quality of the hot dip coated product, the properties of the substrate surface underneath the coating, on the steel substrate surface were measured.

To accomplish this, the coating and inhibition layer of hot dip coated samples having a size of 20 mm×20 mm was stripped from the steel substrate. This was done by placing the samples in batches of maximum 6 samples upright in a pickling solution prepared by mixing:

800 ml water;

155 ml water-based solution of hydrochloric acid containing 37.5 volumetric % of hydrochloric acid; and ml Leuzolit® Extra 283-M, a commercially available over-pickling inhibitor.

The Leuzolit® inhibitor was added to ensure that the steel base is not etched or pickled by the hydrochloric acid and to ensure that pickling does not materially affect the surface texture or roughness of the steel substrate. During this pickling process gas is produced that escaped from the pickling bath through the surface of the pickling solution. Pickling was continued until the gas production had almost stopped, typically taking 10-15 minutes.

Because the surface texture of the steel substrate may have been affected by the temper rolling of the coated steel, the inventors focused on the so-called core roughness of the substrate, because it is more representative of the original cold rolled strip surface.

Core roughness Sk was measured according to the standard and method described above.

For the examples in Table 4 it was found that there was a significant difference in surface texture between the different quality levels even though the hot rolling process as well as the total cold rolling reduction, substrate thickness and width were essentially the same. The substrate that presented a higher surface core roughness had the best surface quality, as followed from the lower number of defects recorded by camera inspection and visual inspection.

Details of examples illustrating this are shown in Table 4 below.

TABLE 4

| Example | Coating type | Thickness [mm] | Width [mm] | Target coating weight (sum of both sides) [g/m$^2$] | Core Roughness (Sk) [μm] | Line speed [m/min] | Gas Knife Distance (GKD) [mm] | Temper mill reduction [%] | Defect count/m$^2$ per side as classified by camera inspection system [indexed, example 3.1 = 100%] | Surface quality ranking |
|---|---|---|---|---|---|---|---|---|---|---|
| 3.1 | ZM | 0.60 | 1489 | 90 | 7.74 | 109 | 10 | 1.5 | 100 | + |
| 3.2 | ZM | 0.60 | 1489 | 90 | 6.05 | 107 | 10 | 1.5 | 407 | 0 |

During further production runs it was noticed that despite relevant hot dip coating conditions being constant, again the quality of the coated product correlated with the cold rolling regime, as can be seen in table 5.

TABLE 5

| Example | Coating type | Thickness [mm] | Width [mm] | Target coating weight (sum of both sides) [g/m$^2$] | Final stand specified work roll roughness [μm] | Specific Rolling Force final stand (SRF) [kN/m] | Average Work roll Radius stand final (AWR) [m] | Line speed [m/min] | Gas Knife Distance (GKD) [mm] | Temper mill reduction [%] | Defect count/m$^2$ per side as classified by camera inspection system [indexed, example 4.1 = 100%] | Surface quality ranking |
|---|---|---|---|---|---|---|---|---|---|---|---|---|
| 4.1 | ZM | 0.60 | 1489 | 90 | 5.6-6.0 | 4900 | 0.237 | 100 | 11 | 1.5 | 100 | 0 |
| 4.2 | ZM | 0.60 | 1489 | 90 | 5.6-6.0 | 5100 | 0.218 | 100 | 11 | 1.5 | 4 | + |
| 4.3 | ZM | 0.60 | 1489 | 90 | 5.6-6.0 | 5100 | 0.218 | 100 | 11 | 1.5 | 19 | + |
| 4.4 | ZM | 0.60 | 1489 | 90 | 5.6-6.0 | 4900 | 0.237 | 100 | 11 | 1.5 | 98 | 0 |

Upon further investigation of the processing conditions on the cold rolling mill, it occurred to the inventors that there was a difference in deformation in the final stand related to the use of a different specific rolling force, the specific rolling force being defined as the total rolling force exerted divided by the width of the strip, in combination with a different work roll radius. A higher rolling force combined with a lower work roll diameter led to a better surface quality and a lower rolling force combined with a higher work roll diameter to a worse surface quality.

Further monitoring of the cold rolling regime on the final stand in particular as to the specific rolling force and the work roll radius was carried out and in order to assess the precise influence of the final stand cold rolling in the cold rolling mill, further trials were performed. Results of these trials are shown in table 6. Clearly a reduced rolling force adversely affects the surface quality of the hot dip coated steel. The number of defects is much higher for the coils with lower specific rolling force on the final stand and the best quality is achieved with the coils produced with higher specific rolling force on the cold mill final stand.

TABLE 6

| Example | Coating type | Thickness [mm] | Width [mm] | Target coating weight (sum of both sides) [g/m$^2$] | Final stand specified work roll roughness [μm] | Specific rolling force final stand (SRF) [kN/m] | Average work roll Radius final stand (AWR) [m] | Core Roughness [Sk] | Line speed [m/min] | Gas Knife Distance (GKD) [mm] | Temper mill reduction [%] | Defect count/m$^2$ per side as classified by camera inspection system [indexed, example 5.1 = 100%] | Surface quality ranking |
|---|---|---|---|---|---|---|---|---|---|---|---|---|---|
| 5.1 | ZM | 0.60 | 1489 | 90 | 5.6-6.0 | 5125 | 0.230 | 6.17 | 130 | 9 | 1.5 | 100 | + |
| 5.2 | ZM | 0.60 | 1489 | 90 | 5.6-6.0 | 3490 | 0.223 | 4.59 | 130 | 9 | 1.5 | 643 | −− |
| 5.3 | ZM | 0.60 | 1489 | 90 | 5.6-6.0 | 5125 | 0.230 | 5.40 | 130 | 9 | 1.5 | 122 | + |
| 5.4 | ZM | 0.60 | 1489 | 90 | 5.6-6.0 | 3490 | 0.223 | 4.36 | 130 | 9 | 1.5 | 661 | −− |

As a next step, trials were performed with increased specific rolling force on the final stand, outside the normal range the operators of the cold mill would normally use. Data of this trial are in Table 7.

TABLE 7

| Example | Coating type | Thickness [mm] | Width [mm] | Target coating weight (sum of both sides) [g/m$^2$] | Final stand specified roughness [μm] | Specific Rolling Force final stand (SRF) [kN/m] | Line speed [m/min] | Gas Knife Distance (GKD) [mm] | Temper mill reduction [%] | Defect count/m$^2$ per side as classified by camera inspection system [indexed, example 6.1 = 100%] | Surface quality ranking |
|---|---|---|---|---|---|---|---|---|---|---|---|
| 6.1 | ZN | 0.60 | 1489 | 90 | 5.6-6.0 | 5011 | 100 | 10 | 1.5 | 100 | + |
| 6.2 | ZM | 0.60 | 1489 | 90 | 5.6-6.0 | 5011 | 100 | 10 | 1.5 | 235 | + |
| 6.3 | ZM | 0.60 | 1489 | 90 | 5.6-6.0 | 6051 | 100 | 10 | 1.5 | 22 | +++ |
| 6.4 | ZM | 0.60 | 1489 | 90 | 5.6-6.0 | 6051 | 100 | 10 | 1.5 | 10 | +++ |

The results show that increased rolling force strongly increases the surface quality by having a much lower defect count on the surface of the strip.

Results of a trial with work roll diameter and roll force are given in table 8.

TABLE 8

| Example | Coating type | Width [mm] | Target Coating [g/m$^2$] | Final stand original roughness [μm] | Specific Rolling Force final stand (SRF) [kN/m] | Average Work roll Radius final stand (AWR) [m] | Core Roughness [Sk] | Line speed [m/min] | Gas Knife Distance (GKD) [mm] | Temper mill reduction [%] | Defect count / m2 per side as classified by camera inspection system [indexed, example 7.1 = 100%] | Surface quality ranking |
|---|---|---|---|---|---|---|---|---|---|---|---|---|
| 7.1 | ZM | 1505 | 100 | 5.6-6.0 | 5970 | 0.239 | 9.32 | 100 | 8 | 1.5 | 100 | ++ |
| 7.2 | ZM | 1505 | 100 | 5.6-6.0 | 5934 | 0.217 | 10.30 | 100 | 8 | 1.5 | 3 | +++ |
| 7.3 | ZM | 1505 | 100 | 5.6-6.0 | 4190 | 0.239 | 7.10 | 100 | 8 | 1.5 | 1001 | 0 |
| 7.4 | ZM | 1505 | 100 | 5.6-6.0 | 4217 | 0.217 | 7.32 | 100 | 8 | 1.5 | 400 | + |

The results of the trials clearly show that a combination of high specific rolling force and smaller average work roll radius results in a lower defect count and also that the higher the specific rolling force divided by the roll radius, the better the chance on excellent surface quality.

As roughness transfer during cold rolling is higher for thicker and/or softer material and lower for thinner and/or harder material, the same final stand processing in terms of specific rolling force and average work roll radius, may result in a different core roughness for a material of a different gauge or strength. For thinner and/or stronger material it is therefore required to increase the rolling force further to obtain the same core roughness as for thicker and/or softer material. Nevertheless, increasing the specific rolling force and/or decreasing the average work roll radius of the final stand improves the chance on excellent surface quality.

The difference between roughness transfer for different materials is illustrated in Table 9 where a thinner material rolled with higher specific rolling force and similar diameter has lower core roughness. To take this into account, the surface characteristic Sc=Sk/(0.7*t+0.3) wherein t is the thickness of the steel substrate in mm, is introduced as a measure to better compare the effectiveness of the final stand rolling process for different material thicknesses.

TABLE 9

| Example | Coating type | Thickness [mm] | Width [mm] | Target Coating weight [g/m$^2$] | Final stand specified roughness [μm] | Specific Rolling Force final stand [kN/m] | Average Work roll Radius final stand [m] | Core Roughness (Sk) [μm] | Surface Characteristic (Sc) [μm] |
|---|---|---|---|---|---|---|---|---|---|
| 8.1 | ZM | 0.65 | 1491 | 80 | 5.6-6.0 | 6006 | 0.224 | 8.28 | 10.92 |
| 8.2 | ZM | 0.80 | 1601 | 70 | 5.6-6.0 | 6078 | 0.225 | 9.42 | 10.93 |

In a further attempt to maintain the low level of surface defects detected by the camera inspection system and to improve the waviness of the coated steel sheet after deformation, the inventors also tested the influence of the rolling force for a lower work roll roughness, the results of which are shown in tables 10 and 13.

The waviness after deformation was established by measuring in the rolling direction, Wsa (1-5) in μm according to SEP 1941, after having deformed the sample in bi-axial direction by 5% using a Marciniak tool.

This proved to work in a similar way resulting in excellent waviness after deformation as well as a low number of defect detections by the camera system. This is seen in the examples below:

TABLE 10

| Example | Coating type | Width [mm] | Target Coating weight (sum of both sides) [g/m$^2$] | Final stand specified roughness [μm] | Specific Rolling Force final stand (SRF) [kN/m] | Average Work roll Radius final stand (AWR) [m] | Core Roughness (Sk) [μm] | Line speed [m/min] | Gas Knife Distance (GKD) [mm] | Temper mill reduction [%] | Waviness Wsa (5% Marciniak) rd [μm] | Surface quality ranking |
|---|---|---|---|---|---|---|---|---|---|---|---|---|
| 9.1 | ZM | 1640 | 70 | 5.6-6.0 | 5985 | 0.214 | 8.70 | 120 | 8 | 1.4 | 0.36 | +++ |
| 9.2 | ZM | 1640 | 70 | 5.6-6.0 | 5985 | 0.214 | 7.40 | 120 | 8 | 1.4 | 0.37 | +++ |
| 9.3 | ZM | 1640 | 70 | 5.6-6.0 | 5903 | 0.214 | 7.21 | 120 | 8 | 1.4 | 0.35 | +++ |
| 9.4 | ZM | 1640 | 70 | 4.2-4.7 | 5943 | 0.232 | 4.83 | 120 | 8 | 1.4 | 0.29 | +++ |
| 9.5 | ZM | 1640 | 70 | 4.2-4.7 | 5914 | 0.232 | 5.23 | 120 | 8 | 1.4 | 0.31 | +++ |
| 9.6 | ZM | 1640 | 70 | 4.2-4.7 | 5972 | 0.232 | 4.74 | 120 | 8 | 1.4 | 0.28 | +++ |

The resulting waviness is not only dependent on the work roll roughness in the cold mill, but also on the gas knife distance (GKD) and cooling conditions after wiping. Trials by the inventors showed that the smaller the knife distance and the later the strip is cooled after it has left the zinc pot, the lower the resulting waviness of the coating after deformation will be. This is illustrated by the examples in Table 11 and Table 12.

TABLE 11

| Example | Coating type | Thickness [mm] | Width [mm] | Target Coating weight (sum of both sides) [g/m$^2$] | Final stand specified roughness [μm] | Line speed [m/min] | Gas Knife Distance (GKD) [mm] | Temper mill reduction [%] | Waviness Wsa (5% Marciniak) rd [μm] |
|---|---|---|---|---|---|---|---|---|---|
| 10.1 | ZM | 0.72 | 1780 | 70 | 4.2-4.7 | 100 | 7 | 1.5 | 0.33 |
| 10.2 | ZM | 0.72 | 1780 | 70 | 4.2-4.7 | 100 | 7 | 1.5 | 0.36 |
| 10.3 | ZM | 0.72 | 1780 | 70 | 4.2-4.7 | 100 | 6 | 1.5 | 0.41 |
| 10.4 | ZM | 0.72 | 1780 | 70 | 4.2-4.7 | 100 | 6 | 1.5 | 0.43 |
| 10.5 | ZM | 0.72 | 1780 | 70 | 4.2-4.7 | 90 | 6 | 1.5 | 0.26 |

TABLE 12

| Example | Coating type | Thickness [mm] | Target Coating weight (sum of both sides) [g/m$^2$] | Final stand specified roughness [μm] | Line speed [m/min] | Knife slot width (D) [mm] | Gas Knife Distance (GKD) [mm] | Temper mill reduction [%] | Flow Cooler 1 [m$^3$/hr] | Flow Cooler 2 [m$^3$/hr] | Flow Cooler 3 [m$^3$/hr] | Flow Cooler 4 [m$^3$/hr] | Strip Temperature at Top roll [° C.] | Cooling in second half of cooling tower p [%] | Waviness Wsa (5% Marciniak) rd [μm] |
|---|---|---|---|---|---|---|---|---|---|---|---|---|---|---|---|
| 11.1 | ZM | 0.60 | 80 | 4.2-4.7 | 100 | 1.0 | 7 | 1.5 | 0 | 0 | 31525 | 43650 | 235 | 100 | 0.35 |
| 11.2 | ZM | 0.60 | 80 | 4.2-4.7 | 100 | 1.0 | 7 | 1.5 | 65000 | 0 | 12125 | 14550 | 235 | 28 | 0.40 |
| 11.3 | ZM | 0.60 | 80 | 4.2-4.7 | 100 | 1.0 | 6 | 1.5 | 0 | 0 | 31525 | 43650 | 235 | 100 | 0.41 |
| 11.4 | ZM | 0.60 | 80 | 4.2-4.7 | 100 | 1.0 | 6 | 1.5 | 65000 | 0 | 12125 | 14550 | 235 | 28 | 0.52 |

The experiments presented in table 12 concern variation of the percentage p of the active cooling gas flow (in m3/hr from the blowers) used in the second half of the cooling tower. The active cooling gas flow, in this document also referred to as Q, here represents the active cooling gas flow required to maintain the strip temperature within a bandwidth of 20 degrees of a target strip temperature of 230° C. at the first roll in the cooling tower that the strip passes after the gas knives. In the examples the total flow Q is the sum of the flow from coolers 1-4. Cooler 3 and 4 in this example are positioned in the second half of the cooling tower so the combined flow of cooler 3 and 4 divided by Q multiplied by 100 equals p. The results show that when a large percentage p of Q is applied in the second half of the cooling tower, the waviness of the strip is improved as the strip is allowed to cool as slow as possible in the first half.

These results show that the method can be used to produce excellent hot dip coated strip with low numbers of defects as well as very low levels of waviness after deformation.

Based on the whole investigation and the examples in Table 13 below it was concluded that the combinations of Sc and Wsa lying within contour ABCDEA as shown in FIG. 1 represent high quality hot dip coated products allowing a highly effective manufacturing method.

TABLE 13

| Example | Coating type | Thickness [mm] | Width [mm] | Target Coating weight (sum of both sides) [g/m$^2$] | Final stand specified roughness [μm] | Specific Rolling Force final stand (SRF) [kN/m] | Radius final stand (AWR) Average Work roll [m] | SRF/AWR [kN/m$^2$] | Core Roughness (Sk) [μm] | Surface Characteristic (Sc) [μm] | Gas Knife Distance (GKD) [mm] | Cooling in second half of cooling tower p [%] | Waviness Wsa (5% Marciniak) rd [μm] | Surface quality ranking | Symbol in FIG. 1 Below |
|---|---|---|---|---|---|---|---|---|---|---|---|---|---|---|---|
| 12.1 | ZM | 0.60 | 1489 | 90 | 5.6-6.0 | 3490 | 0.223 | 15.652 | 4.59 | 6.38 | 10 | >75 | 0.42 | −− | − |
| 12.2 | ZM | 0.60 | 1489 | 90 | 4.2-4.7 | 4300 | 0.215 | 20.000 | 4.10 | 5.70 | 6 | >75 | 0.31 | − | − |
| 12.3 | ZM | 0.60 | 1489 | 90 | 4.2-4.7 | 4270 | 0.214 | 20.000 | 3.79 | 5.27 | 9 | >75 | 0.37 | − | − |
| 12.4 | ZM | 0.60 | 1489 | 90 | 5.6-6.0 | 5125 | 0.230 | 22.283 | 6.17 | 8.57 | 9 | >75 | 0.32 | + | 0 |
| 12.5 | ZM | 0.75 | 1505 | 100 | 5.6 6.0 | 6066 | 0.239 | 25.379 | 9.04 | 10.95 | 8 | >75 | 0.41 | ++ | + |
| 12.6 | ZM | 0.75 | 1505 | 100 | 5.6-6.0 | 6066 | 0.239 | 25.379 | 8.60 | 10.43 | 8 | >75 | 0.41 | ++ | + |
| 12.7 | ZM | 0.60 | 1489 | 90 | 4.2-4.7 | 6000 | 0.232 | 25.862 | 4.82 | 6.69 | 7 | >75 | 0.32 | ++ | + |
| 12.8 | ZM | 0.75 | 1505 | 100 | 5.6-6.0 | 5934 | 0.217 | 27.347 | 10.30 | 12.49 | 8 | >75 | 0.40 | +++ | X |
| 12.9 | ZM | 0.75 | 1640 | 70 | 5.6 6.0 | 5985 | 0.214 | 27.966 | 8.70 | 10.55 | 7 | >75 | 0.36 | +++ | X |
| 12.10 | ZM | 0.75 | 1640 | 70 | 5.6-6.0 | 6054 | 0.214 | 28.357 | 8.05 | 9.76 | 7 | >75 | 0.28 | +++ | X |

The product is even better if the combination of Sc and Wsa falls within the contour A'FCDEA' and still better if it falls within the contour A"GCDEA".

The lines EA, EA' and EA" represent the roughness required to allow proper strip tracking in the hot dip coating line and prevent slippage and scratching.

The lines BC, FC and GC indicate a maximum waviness above which the paint appearance of the steel, when it is finally painted, is no longer sufficient for the application in high quality visible components.

The line CD represents the maximum Sc beyond which the benefit of the invention is counteracted by the fact that firstly the average roughness becomes higher than attainable for customer desired coating weights and secondly an extremely high wiping pressure is required to control the coating weight for thin coatings.

In the course of the experiments the use of the cold rolling regime according to the invention was also tested for GI and it was confirmed that also for other types of coatings than ZM, the number of defects is reduced by the invention. The results are shown in Table 14.

TABLE 14

| Example | Coating type | Thickness [mm] | Width [mm] | Target Coating weight (sum of both sides) [g/m$^2$] | Final stand specified roughness [μm] | Specific Rolling Force final stand (SRF) [kN/m] | Average Work roll Radius final stand (AWR) [m] | Line speed [m/min] | Gas Knife Distance (GKD) [mm] | Temper mill reduction [%] | Defect count/m2 per side as classified by camera inspection system [indexed, example 13.1 = 100%] | Surface quality ranking |
|---|---|---|---|---|---|---|---|---|---|---|---|---|
| 13.1 | GI | 0.75 | 1505 | 140 | 5.6-6.0 | 4200 | 0.239 | 120 | 8 | 1.4 | 100 | + |
| 13.2 | GI | 0.75 | 1505 | 140 | 5.6-6.0 | 6000 | 0.215 | 120 | 8 | 1.4 | 4 | +++ |
| 13.3 | GI | 0.75 | 1505 | 140 | 5.6-6.0 | 4200 | 0.239 | 120 | 8 | 1.4 | 107 | + |
| 13.4 | GI | 0.75 | 1505 | 140 | 5.6-6.0 | 6000 | 0.215 | 120 | 8 | 1.4 | 17 | +++ |
| 13.5 | GI | 0.75 | 1505 | 140 | 5.6-6.0 | 4200 | 0.239 | 120 | 8 | 1.4 | 58 | + |

The invention is carried out by preference in combination with a steel substrate that has a composition, all in weight %, having: C max 0.04 or max 0.01 or max 0.007, and/or Mn max 1.2 or max 0.80, and/or Si max 0.50 or max 0.30, and/or Al max 0.1 or max 0.08, and/or P max 0.15 or max 0.10, and/or S max 0.045 or max 0.020, and/or N max 0.01 or max 0.008 or max 0.004, and/or Ti max 0.12 or max 0.08, and/or Nb max 0.12 or max 0.03, and/or Mo max 0.12 or max 0.01, and one or more of the optional elements: Cu max 0.10 or max 0.08, Cr max 0.06 or max 0.04, Ni max 0.08, B max 0.0025 or max 0.0015, V max 0.01 or max 0.004, Ca max 0.01, Co max 0.01, Sn max 0.01, the remainder being iron and unavoidable impurities.

It is remarked that in this patent document Ra of a surface stands for its roughness according to ISO-NEN 468-1982, with a cut-off of 2.5 mm.

Further, it is remarked that the Waviness value Wsa is the Wsa (1-5), in μm, determined in accordance with SEP1941: 2012-05 in the rolling direction of the strip (denoted herein also as "rd"), and where applicable after a 5% Marciniak bi-axial deformation.

Finally it is remarked that in the formula's "*" stands for multiplication, "/\" for exponentiation.

The invention claimed is:

1. A method of manufacturing a steel strip for use in an automobile body, comprising the subsequent steps of hot rolling the strip into a hot rolled strip, cold rolling the hot rolled strip and hot dip coating the cold rolled strip with a Zn based coating by leading the strip through a bath comprising molten zinc and wiping the strip after said coating using a gas knife having a knife slot from which a wiping gas is projected, wherein:

the steel strip is cold rolled to a final cold rolled thickness of between 0.40 mm and 1.00 mm in a multi-stand cold rolling mill wherein cold rolling in the last stand takes place such that:

$$\frac{SRF}{AWR} \geq 21000 \text{ kN/m}^2$$

wherein SRF is the specific rolling force expressed in kN/m calculated as the rolling force in kN divided by the strip width in m, and AWR is the average work roll radius in m of a top work roll and a bottom work roll at mid roll position, and wherein GKD is the average distance between the knife slot from which the wiping gas is projected and the surface of the coated strip that is being wiped, wherein GKD≤10 mm;

wherein a bath of molten metal has a composition comprising Zn, Al and Mg, wherein the strip after coating and wiping is cooled in a cooling section between the location where the strip is wiped and a downstream location where the strip is first contacted by a guiding roll;

wherein an active cooling gas flow Q in m3/hr is used which is required to maintain the strip temperature within 20° C. of a target strip temperature in the range between 200° C. and 300° C. at said guiding roll;

wherein the cooling gas flow in the second half of the cooling section is a percentage p of Q and the cooling gas flow in the first half of the cooling section is a percentage of (100-p) of Q, wherein p is set at 70% or more; and wherein cold rolling in the last stand takes place using work rolls that have a roughness Ra which is 7 μm or less but in all cases 1.0 μm or more.

2. The method according to claim 1, wherein $$\frac{SRF}{AWR} \geq 22000 \text{ kN/m}^2.$$

3. The method according to claim 1, wherein cold rolling in the last stand takes place using work rolls that have a roughness Ra which is 6 μm or less but in all cases 1.0 μm or more.

4. The method according to claim 1, wherein GKD is the average distance between the knife slot from which the wiping gas is projected and the surface of the coated strip that is being wiped wherein GKD≤9 mm.

5. The method according to according to claim 1, wherein p is set at 80% or more.

6. The method according to according to claim 1, wherein the bath consists of 0.6-4.0 weight % aluminium and 0.3-4.0 weight % magnesium, optionally up to 0.2 weight % each of an element belonging to the group of elements given by Pb, Sb, Ti, Ca, Mn, Sn, La, Ce, Cr, Ni, Zr and Bi, the remainder being unavoidable impurities and zinc.

7. The method according to claim 6, wherein the aluminium content is 0.6-3.0 weight % and/or the magnesium content is 0.3-2.0 weight %.

8. The method according to claim 1, wherein the bath consists of 0.20-0.90 weight % aluminium, and up to 0.2 weight % each of an element belonging to the group of elements given by Pb, Sb, Ti, Ca, Mn, Sn, La, Ce, Cr, Ni, Zr and Bi, the remainder being unavoidable impurities and zinc.

9. The method according to according to claim 1, wherein the hot dip coated strip is temper rolled with an elongation of 0.5% or more, using a temper work roll with an average diameter of 400 mm or more.

10. The method according to claim 9, wherein a temper work roll roughness Ra is used of 4.5 μm or less.

11. The method according to claim 1, performed with the purpose of producing a hot dip coated steel sheet having in its end use, in deformed state, a guaranteed maximum waviness Wsa which is the Wsa (1-5) value, measured in rolling direction, according to SEP 1941, of 0.35 μm or lower.

12. The method according to claim 1, wherein the steel strip comprises a steel substrate provided with a Zn based hot dip coating, the steel substrate having a thickness of between 0.40 mm and 1.00 mm, wherein:

the steel substrate has a composition, all in weight %:

C max 0.04;
Mn 0.01-1.20;
Si 0.001-0.50;
AI 0.005-0.1;
P max 0.15;
S max 0.045;
N max 0.01;
Mo max 0.12;
Ti max 0.12;
Nb max 0.12;
Cu: max 0.10;
Cr: max 0.06;
Ni: max 0.08;
B: max 0.0025;
V: max 0.01;
Ca: max 0.01;
Co: max 0.01;
Sn: max 0.01;

the remainder being iron and unavoidable impurities;

the steel strip has a surface characteristic Sc, Sc being defined as:

Sc=Sk/(0.7*t+0.3), wherein Sk in μm is defined according to NEN-EN-ISO 25178-2:2012 and t is the thickness of the steel substrate in mm being between 0.40 mm and 1.00 mm, and the steel strip, after a 5% Marciniak bi-axial deformation, has a waviness Wsa which is the Wsa (1-5) value in μm, measured in rolling direction, according to SEP 1941, wherein the combination Sc and Wsa lies within an area defined by a contour ABCDEA in an XY-plot of Sc and Wsa respectively, wherein:

A is defined as the intersection of Sc=3.00 and Wsa=(0.2686)−(0.0543*Sc)+(0.0105*Sc^2);

AB is defined by Wsa=(0.2686)−(0.0543*Sc)+(0.0105*Sc^2) from Sc=3.00 at A to Wsa=0.50 at B;

BC is defined by Wsa=0.50 from B to C, C having Sc=14.50;

CD is defined by Sc=14.50 for Wsa=0.50 at C to Wsa=0.10 at D;

DE is defined by Wsa=0.10 for Sc=14.50 at D to Sc=3.00 at E; and

EA closes the contour and is defined by Sc=3.00 from E to A.

13. The method according to claim 12, wherein the combination Sc and Wsa lies within an area defined by a contour A'FCDEA' in an XY plot of Sc and Wsa respectively, wherein:

A' is defined as the intersection of Sc=3.00 and Wsa=(0.2276)−(0.0266*Sc)+(0.0054*Sc^2);

A'F is defined by Wsa=(0.2276)−(0.0266*Sc)+(0.0054*Sc^2) for Sc=3.00 at A' to Wsa=0.50 at F;

FC is defined by Wsa=0.50 from F to C, C having Sc=14.50;

CD is defined by Sc=14.50 for Wsa=0.50 at C to Wsa=0.10 at D;

DE is defined by Wsa=0.10 for Sc=14.50 at D to Sc=3.00 at E; and

EA' closes the contour and is defined by Sc=3.00 from E to A'.

14. The method according to claim 12, wherein the combination Sc and Wsa lies within an area defined by a contour A"GCDEA" in an XY plot of Sc and Wsa respectively, wherein:

A" is defined as the intersection of Sc=3.00 and Wsa=(0.208)−(0.0118*Sc)+(0.0027*Sc^2);

A"G is defined by Wsa=(0.208)−(0.0118*Sc)+(0.0027*Sc^2) for Wsa=0.20 to Wsa=0.50 at G;

GC is defined by Wsa=0.50 from B to C, C having Sc=14.50;

CD is defined by Sc=14.50 for Wsa=0.50 at C to Wsa=0.10 at D;

DE is defined by Wsa=0.10 for Sc=14.50 at D to Sc=3.00 at E; and

EA" closes the contour and is defined by Sc=3.00 from E to A".

15. The method according to claim 1, wherein the steel strip has a total coating weight on both sides together of 60-175 g/m$^2$.

16. The method according to claim 1, wherein the steel strip has a surface roughness Ra between 0.9 μm and 1.8 μm.

17. The method according to claim 1, wherein the steel strip comprises a steel substrate provided with a Zn based hot dip coating, the steel substrate having a thickness of between 0.40 mm and 1.00 mm, wherein:

the steel strip has a surface characteristic Sc, Sc being defined as:

Sc=Sk/(0.7*t+0.3), wherein Sk in μm is defined according to NEN-EN-ISO 25178-2:2012 and t is the thickness of the steel substrate in mm being between 0.40 mm and 1.00 mm, and the steel strip, after a 5% Marciniak bi-axial deformation, has a waviness Wsa which is the Wsa (1-5) value in μm, measured in rolling direction, according to SEP 1941, wherein the combination Sc and Wsa lies within an area defined by a contour ABCDEA in an XY-plot of Sc and Wsa respectively, wherein:

A is defined as the intersection of Sc=3.00 and Wsa=(0.2686)−(0.0543*Sc)+(0.0105*Sc∧2);

AB is defined by Wsa=(0.2686)−(0.0543*Sc)+(0.0105*Sc∧2) from Sc=3.00 at A to Wsa=0.50 at B;

BC is defined by Wsa=0.50 from B to C, C having Sc=14.50;

CD is defined by Sc=14.50 for Wsa=0.50 at C to Wsa=0.10 at D;

DE is defined by Wsa=0.10 for Sc=14.50 at D to Sc=3.00 at E; and

EA closes the contour and is defined by Sc=3.00 from E to A.

18. The method according to claim 1, wherein $$\frac{SRF}{AWR} \geq 27000 \text{ kN/m}^2.$$

19. The method according to claim 1, wherein the steel substrate has a composition, all in weight %:

C max 0.04;
Mn 0.01-1.20;
Si 0.001-0.50;
Al 0.005-0.1;
P max 0.15;
S max 0.045;
N max 0.01;
Mo max 0.12;
Ti max 0.12;
Nb max 0.12;
Cu: max 0.10;
Cr: max 0.06;
Ni: max 0.08;
B: max 0.0025;
V: max 0.01;
Ca: max 0.01;
Co: max 0.01;
Sn: max 0.01;
the remainder being iron and unavoidable impurities.

20. The method according to claim 1, wherein the Zn based coating is a Zn—Al—Mg coating.

* * * * *